US005162604A

United States Patent [19]

Wilson

[11] Patent Number: 5,162,604

[45] Date of Patent: Nov. 10, 1992

[54] IMPLOSIVE CARTRIDGE CASE FOR RECOILLESS RIFLES

[75] Inventor: David Wilson, Saratoga, N.Y.

[73] Assignee: The United States of America as represented by the Secretary of the Army, Washington, D.C.

[21] Appl. No.: 849,861

[22] Filed: Mar. 12, 1992

[51] Int. Cl.[5] ..... F41A 1/08; F42B 5/05

[52] U.S. Cl. ..... 89/1.7; 102/430; 102/437; 102/464; 102/530

[58] Field of Search ..... 89/1.7, 1.704, 1.706; 102/430, 433, 434, 487, 443, 464, 470, 374, 380, 530, 531

[56] References Cited

U.S. PATENT DOCUMENTS

| | | | |
|---|---|---|---|
| 3,572,248 | 3/1971 | Dardick | 102/443 |
| 4,151,780 | 5/1979 | Andersson | 89/1.7 |
| 4,770,099 | 9/1988 | Brede et al. | 102/430 |

FOREIGN PATENT DOCUMENTS

| | | | |
|---|---|---|---|
| 868494 | 4/1971 | Canada | 89/1.7 |

*Primary Examiner*—Harold J. Tudor

*Attorney, Agent, or Firm*—Anthony T. Lane; Edward Goldberg; Michael C. Sachs

[57] ABSTRACT

A cartridge case assembly suitable for use in recoilless weapon systems including large caliber weapons is provided which includes an elongated cylindrically shaped inner cartridge case having a plurality of spaced perforations substantially about the periphery of the case wall and opposite open ends; an elongated cylindrically shaped shell member mounted about the inner cartridge case to envelope the periphery thereof and provide an annular propellant charge chamber therebetween, the shell member being of sufficient strength to constrain the passage of propellant gases outwardly from about the wall of the cartridge case upon ignition of a propellant charge within said propellant charge chamber; and a plurality of spaced elongated ignitor tubes associated with said cartridge case along the length thereof, each of ignitor tubes having a plurality of spaced perforations therethrough for distribution of ignition gases to the propellant charge.

5 Claims, 3 Drawing Sheets

IMPLOSIVE CARTRIDGE CASE FOR RECOILLESS RIFLES

Governmental Interest

The invention described herein may be manufactured, used, and licensed by or for the Government for Government purposes without payment to me of any royalties thereon.

FIELD OF THE INVENTION

The present invention relates to recoilless weapons and, more particularly, to improved cartridge cases for cartridges, projectiles and the like for recoilless weapon systems including large caliber weapons.

BACKGROUND OF THE INVENTION

A longstanding problem in recoilless weapon systems, such as recoilless rifles, projectile launchers and the like, has been the large amounts of unburnt propellant that exits from recoilless weapon systems. Propellant loss can account for as much as 30% of the total propellant charge weight. In large caliber systems, this problem can be even more pronounced due to the large amount of propellant needed to operate the system as well as the large exit nozzle area needed to maintain recoillessness.

Heretofore, several different cartridge case and propellant chamber configurations have been employed for recoilless weapon systems including large caliber weapons that require holding large amounts of propellant charge and for igniting the charge. Various perforated cartridge case designs are known and have been used. For example, a perforated cartridge case where propellant ignited inside the perforated case has been used in conjunction with a kidney-shaped exit nozzle where the gases expand radially outwardly into the propellant chamber and then exit through the nozzle. Such nozzle design is limited in efficiency in terms of recoillessness and perforated cartridge cases have been used in conjunction with a blowout disc for more efficient central nozzle designs. A blowout disc is employed in such systems to control the amount of combustion which takes place prior to gas discharge by confining the propellant gas until the disc ruptures, the disc having a great influence on the amount of unburnt propellent loss during the initial stage of burning. In such design, the propellant gases generated pass through the cartridge case perforations into the annular chamber and then, after rupture of the blowout disc, the gases pass from the chamber back across the cartridge case wall and out through the nozzle. However, while the blowout disc has a great deal of influence on the loss of propellent during the initial stage of burning, the blowout disc in itself is a projectile which exits from the weapon through the nozzle. Further, the bigger the weapon, the more rigid the disc must be to contain the pressure in the chamber to facilitate proper propellant burning. Other known designs include frangible cartridge cases wherein the case is destroyed during firing of the weapon, and the use of the principle of exposed strip propellant mounted along the inner chamber wall. However, the frangible case design can adversely influence the interior ballistics of the weapon by the manner in which burning of the case can affect the propellant ignition and combustion, and the exposed propellant strip design has a disadvantage in effecting proper ignition of the propellant, large chunks of propellant generally breaking off and blowing out of the central nozzle during ignition and burning of the propellants.

When using a central orifice nozzle design, the case designs heretofore employed generally require the use of a blowout disc in the throat of the nozzle which, as indicated, in large caliber weapons must be quite rigid to contain the pressures in the chamber and facilitate proper propellant burning, increasing the danger of the disc as projectile when exiting the weapon. Moreover, conventional designs require the entire chamber to be pressurized to insure proper propellant ignition and employ the principle of radially expanding gases in a large volume chamber. The large amounts of propellants required to supply enough gas to pressurize the system generally results in large amount of unburnt propellant being thrown about the chamber and then blown out and lost through the nozzle.

SUMMARY OF THE INVENTION

It is accordingly an object of the present invention to provide a cartridge case design for recoilless weapon systems such as recoilless rifles and projectiles of varying sizes including large caliber weapon systems which reduces the exposed chamber volume required during ignition of the propellant, requires no burst disc in the throat of the nozzle and employs the principle of gas implosion, i.e. the propellant gas is directed inwardly toward the central axis of the weapon, whereby the propellant charge is more efficiently burned, the amount of unburnt propellant is reduced and propellant gas is more efficiently distributed for propelling the cartridge or projectile and providing counter recoil for the system.

It is another object of the present invention to provide a cartridge case design for recoilless weapon systems including large caliber weapon systems having a perforated cartridge case and a cylindrically shaped frangible containment shell or sleeve member adapted for effectively controlling development of propellant gas formation during the ignition and initial combustion of propellant in the cartridge case wherein upon bursting of the containment shell member, propellant gas in the propellant chamber is directed inwardly through the perforated cartridge case to effectively filter unburnt propellant masses and distribute the propellant gas to propel a projectile and effect counter recoil for the system.

It is a further object of the present invention to provide a cartridge case design having an inner perforated tubular cartridge case member and a frangible shell or sleeve containment member associated with the inner cartridge case member of sufficient strength for controlling propellant gas formation during ignition of the propellant charge by closing off the perforations in the cartridge case member without blocking the recoil exit nozzle, and then bursting or breaking through to permit flow of propellant gases into the propellant chamber and through the perforated cartridge case member to the recoil exit nozzle.

It is a still further object of the present invention to provide a cartridge case assembly for recoilless weapon systems having an inner case member with a plurality of perforations through the wall arrayed about the periphery thereof suitable for filtering unburnt propellant charge from propellant gases, a constraining shell or cylinder mounted about the inner perforated case member of suitable strength for retaining a propellant charge therebetween and for constraining propellant gases during operation of the propellant charge until suitable propellant gas pressures are built up without restricting the exit nozzle and a plurality of elongated ignition tubes embedded within the propellant charge about the periphery of the inner case member adapted for efficient ignition of the charge, whereby propellant gas pressures are built-up upon ignition of the charge, the propellant charge is effectively ignited and burnt with minimized amount of unburnt propellant charge being expelled and propellant gases are distributed through the interior of the cartridge case to propel the projectile and provide counter recoil through the exit nozzle.

In accordance with the present invention, there is provided a cartridge case assembly for recoilless weapon systems comprising:

an elongated cylindrically shaped cartridge case having a plurality of spaced perforations substantially about the periphery of the case wall and opposite open ends;

an elongated cylindrically shaped shell or cylinder member mounted about said cartridge case to envelope the periphery thereof and provide an annular propellant charge chamber therebetween, said shell or cylinder being of sufficient strength to constrain the passage of propellant gases outwardly through the perforations in the wall of the cartridge case upon ignition and operation the propellant charge; and a plurality of spaced elongated ignitor tube means associated with said cartridge case along the length thereof, each of said ignitor tube means having a plurality of spaced perforations therethrough for distribution of ignition gases to the propellant charge.

Other objects, features and advantages will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DESCRIPTION OF THE PREFERRED EMBODIMENTS

Figure 1:
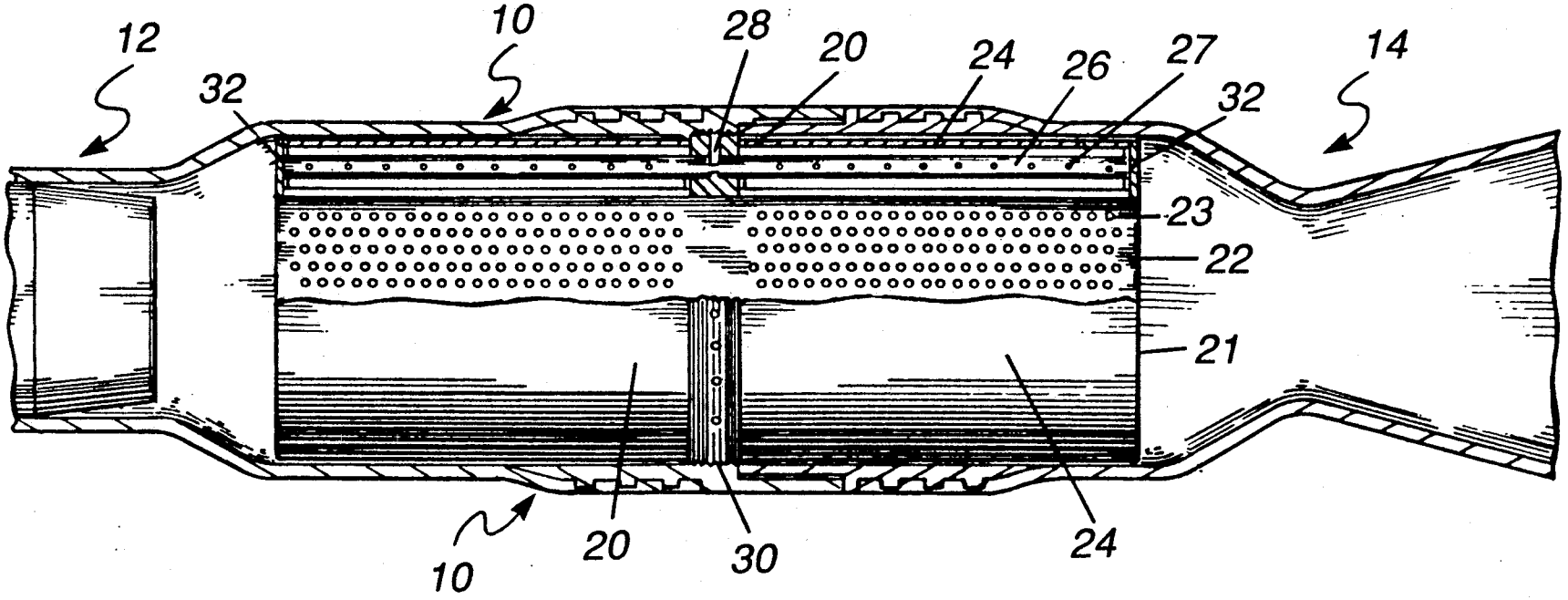
FIG. 1 is a side elevation view in cross section of a recoilless weapon propellant chamber illustrating a cartridge case, part broken away, embodying the principles of the present invention.
Figure 3:
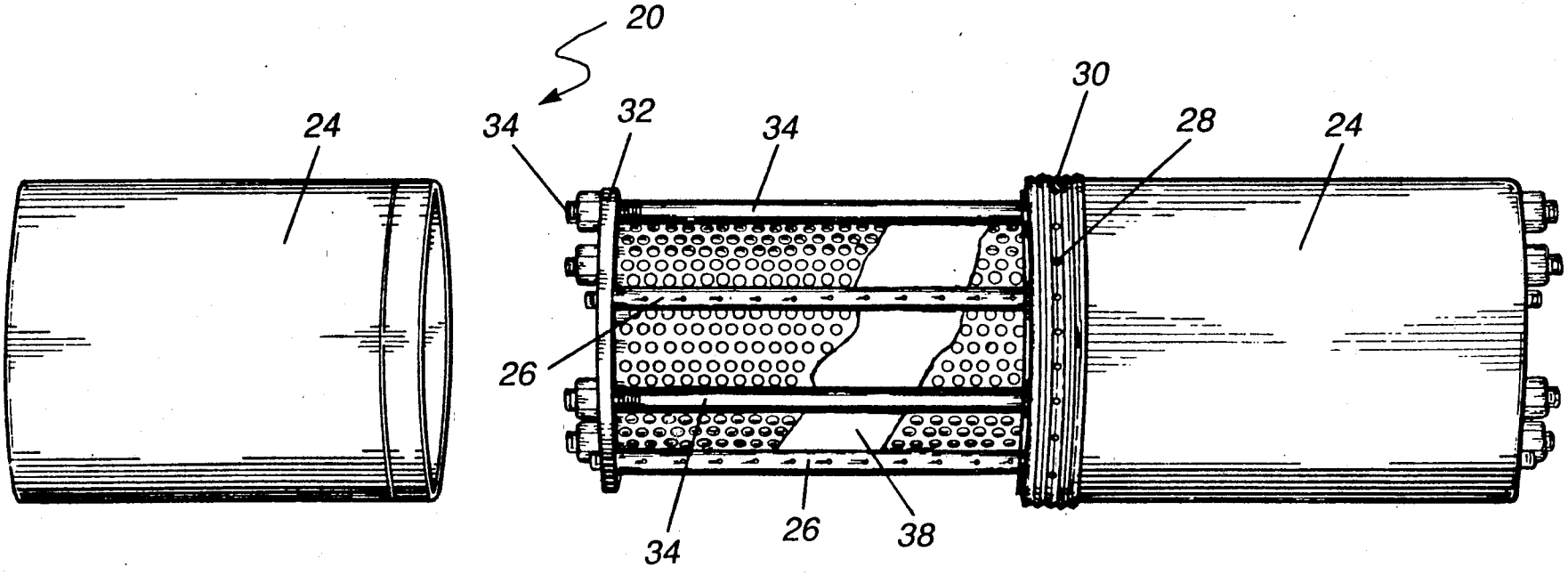
FIG. 3 is an exploded side elevation view of a cartridge case for a recoilless weapon embodying the principles of the present invention.

Referring now to the drawings wherein like numerals identify like parts, there is shown in FIGS. 1 and 3 the propellant chamber or housing of a recoilless weapon shown generally as 10, which extends from the launch tube 12 at the front end to the exit nozzle 14 at the rear end and wherein is located a cartridge case assembly 20 of the present invention, preferably closely fitting within the propellant chamber 10, which includes an elongated inner cylindrically shaped tube 22 having a plurality of spaced perforations 23 arrayed over substantially the entire periphery thereof, an elongated cylindrically shaped containment shell or cylinder 24 mounted about the inner perforated tube 22 and spaced therefrom, and a plurality of elongated ignitor tubes 26 which are mounted about the periphery of the inner perforated tube 22 within an annular chamber 21 defined by the inner perforated tube 22 and the outer containment shell or cylinder 24 in communication with a primer gas inlet port 28.

The propellant chamber 10 is constructed by joining the rear end of the weapon system launch tube 12 and the recoil nozzle end 14, the assembly thereof defining the propellant chamber or housing 10 of the recoilless weapon system. The launch tube 12 and nozzle 14 components may be fabricated from a variety of known composite materials by conventional techniques.

The cartridge case assembly 20 of the invention comprises an inner elongated cylindrical tube 22 having a plurality of spaced perforations 23 arrayed substantially about its entire periphery. A threaded support ring 30 having passages therethrough in communication with inlet port holes 28 is centrally mounted about the inner cylindrical tube 22. The support ring 30 provides support for a plurality of elongated ignitor tubes 26 having spaced apertures thereto which are mounted about the periphery of the inner perforated tube 22 within an annular chamber 21 defined by the inner tube 22 and an elongated outer containment shell or cylinder 24 for the inner tube 22. The ignitor tubes 26 are centrally supported in spaced parallel disposition and project longitudinally outwardly from each side of the support ring 30 with the bores therethrough in communication with passages through the support ring 30. The elongated outer containment shell 24 is formed by two cylindrical segments which are mounted on opposite sides of the support ring 30 about the elongated inner tube 22 and threadedly connected at one end thereto. End caps 32 are placed on each end of the cartridge case assembly 20 to align all parts and seal the unit. The end caps 32 are held together with threaded rods 34 secured to the support ring 30. Depending on the pressure differential across the inner and outer surfaces of the annular chamber 21 and the propellant chamber 10, the threaded rods 34 may not be needed. Moreover, the ignitor tubes 26 may also be strengthened to provide adequate support for the load.

The propellant containment sleeve 38 is formed of a thin metal sheet such as a brass or the like which overlies the perforations 23 in the inner tube 22 and serves as a "burst disc" for the system. The thickness and burst strength properties of the containment sleeve 38 would depend on the type of ignition desired for the particular propellant design. Once the propellant charge is properly ignited, the gases break through the sleeve and enter the propellant chamber 10.

In operation, the ignitor tubes 26 are ignited through gas port holes 28 in support ring 30. Primer gas is directed through gas port holes 28 in the support ring 30 and then dispersed to the ignitor tubes 26 which provide the primary ignition source for the system. The ignitor tubes 26 are filled with powder such as FFFg black powder, and the apertures therein 27 are covered with a liner such as rolled paper to prevent the powder from escaping during handling and storage. Once the ignitor source 26 has been ignited, pressure builds up in the ignitor tube 26 and hot flaming gas is directed out of apertures 27 in the ignitor tube 26, which flame ignites propellent charge in the annular chamber between the perforated inner tube 22 and the outer shell or cylinder 24. Once the propellant charge has been ignited, pressure builds up between inner tube 22 and outer shell 24. When the desired ignition pressure level has been obtained, the propellant containment sleeve 38 ruptures and the propellant gases are then directed inwardly through the perforated inner tube from the propellant chamber as a result of the pressure differential across the perforated tube 22. As the propellant gas passes through the perforations which serves to filter unburnt propellant grains, burning propellant grains must burn to a size equal to or smaller than the perforations in order to pass therethrough. This assists in reducing the probability of unburnt propellant from exiting the system through the nozzle.

In view of the fact that the pressure on the outer part of the perforated tube 22 is greater than within the tube 22, it is generally held in a state of compression. This phenomenon permits the tube 22 to be formed with more perforations per square inch of area over conventional perforated cartridge case designs. Moreover, the diameter of the perforations may be reduced which serves to further filter burning propellant making the burning thereof in the system more propellant efficient.

Figure 2:
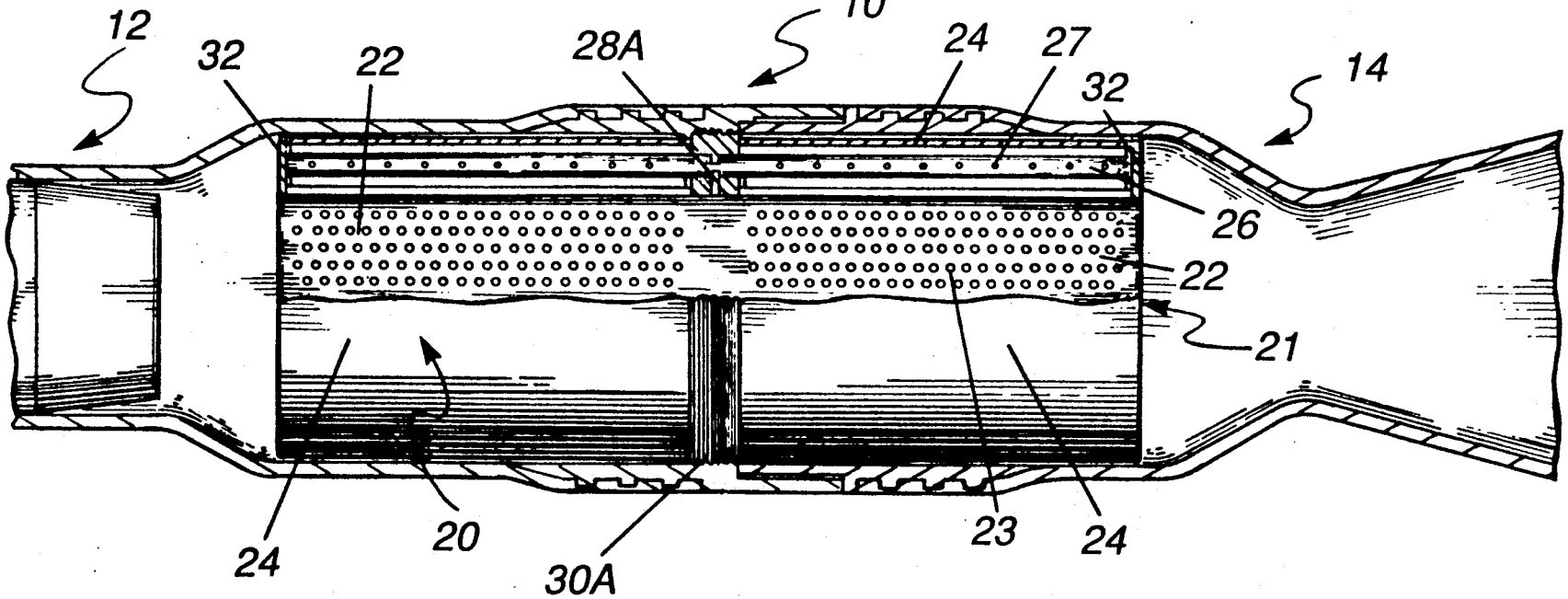
FIG. 2 is a side elevation view in cross section of a recoilless weapon propellant chamber illustrating an alternate embodiment of a cartridge case, part broken away, embodying the principles of the present invention.

In FIG. 2 is illustrated an alternate embodiment of the present invention wherein port holes 28*a* in the support ring are located inside the ring.

The present invention may be embodied in other specific forms without departing from the spirit or essential attributes thereof and accordingly reference should be made to the appended claims rather than to the foregoing specification as indicating the scope of the invention.

What is claimed is:

1. A cartridge case assembly for recoilless weapon systems comprising:

a) an elongated cylindrically shaped inner tube having a plurality of spaced perforations along substantially the entire length thereof and opposite open ends;

b) an imperforate elongated cylindrically shaped shell member surrounding and spaced from said elongated cylindrically shaped inner to envelope the periphery thereof and provide an annular propellant charge chamber therebetween, said shell being of sufficient strength to constrain the passage of propellant gases outwardly from the cartridge case upon ignition and operation of a propellant charge within said annular propellant charge chamber; and c) a plurality of circumferentially arranged, longitudinally extending, spaced elongated tubular ignitor means contained within said annular propellant charge chamber along the length thereof, each of said ignitor tube means having a plurality of spaced perforations therethrough for distribution of ignition gases to the propellant charge.

2. The cartridge case assembly as claimed in claim 1, wherein a support means is mounted centrally about said cylindrically shaped inner tube for supporting said shell member about the periphery of said elongated cylindrically shaped inner tube in spaced relation thereto.

3. The cartridge case assembly as claimed in claim 2, where said ignitor tube means are supported by said support means in spaced relationship about the periphery of said elongated cylindrically shaped inner tube.

4. The cartridge case assembly as claimed in claim 1, wherein a propellant containment sleeve member, which is adapted to burst during combustion of a propellant charge after a desired propellant gas pressure has been developed within the annular propellant charge chamber surrounding said elongated cylindrically shaped inner tube.

5. A recoilless weapon system comprising:

a) a projectile launch tube means at one end;

b) a recoil exit nozzle at an end opposite the launch tube means;

c) a propellant chamber means intermediate the launch tube means and the recoil exit nozzle; and d) a cartridge case assembly located within said propellant chamber means and closely fitting therein, said cartridge case assembly comprising:

i) an elongated cylindrically shaped inner tube having a plurality of spaced perforations along substantially the entire length thereof and opposite open ends;

ii) an imperforate elongated cylindrically shaped shell member surrounding and spaced from said elongated cylindrically shaped inner tube to envelope the periphery thereof and provide an annular propellant charge chamber therebetween, said shell member being of sufficient strength to constrain the passage of propellant gases outwardly from the cartridge case upon ignition and operation of a propellant charge within said annular propellant charge chamber; and iii) a plurality of circumferentially arranged, longitudinally extending, elongated tubular ignitor means contained within said annular propellant charge chamber along the length thereof, each of said ignitor tube means having a plurality of spaced perforations therethrough for distribution of ignition gases to the propellant charge.

* * * * *